United States Patent [19]

Taplin

[11] 4,138,979

[45] Feb. 13, 1979

[54] FUEL DEMAND ENGINE CONTROL SYSTEM

[75] Inventor: Lael B. Taplin, Bloomfield Hills, Mich.

[73] Assignee: The Bendix Corporation, Southfield, Mich.

[21] Appl. No.: 837,658

[22] Filed: Sep. 29, 1977

[51] Int. Cl.[2] ..... F02D 35/00

[52] U.S. Cl. ..... 123/119 EC; 123/32 EA; 123/32 EE

[58] Field of Search ... 123/119 EC, 32 EA, 139 AW, 123/148 E

[56] References Cited

U.S. PATENT DOCUMENTS

| | | | |
|---|---|---|---|
| 3,827,237 | 8/1974 | Linder et al. | 123/32 EE |
| 3,858,561 | 1/1975 | Aono | 123/32 EA |
| 3,861,366 | 1/1975 | Masaki et al. | 123/119 EC |
| 4,019,470 | 4/1977 | Asano | 123/119 EC |
| 4,057,042 | 11/1977 | Aono | 123/32 EE |
| 4,061,055 | 12/1977 | Ilzuka et al. | 123/32 EA |
| 4,075,982 | 2/1978 | Asano et al. | 123/32 EE |
| 4,077,207 | 3/1978 | Hattori et al. | 123/119 EC |

*Primary Examiner*—Charles J. Myhre
*Assistant Examiner*—Raymond A. Nelli
*Attorney, Agent, or Firm*—Gaylord P. Haas, Jr.; Russel C. Wells

[57] ABSTRACT

An electrically controlled closed loop system for maintaining a desired air-fuel ratio within an internal combustion engine. An operator-positioned accelerator commands a given fuel flow into the engine and the flow of air is controlled by means of a servo-actuated throttle plate. The commanded fuel flow and present position of the throttle plate are used to generate a basic command signal for controlling the servo motor to adjusting the position of the throttle plate. A gas detector or roughness sensor positioned in the engine is responsive to the actual air-fuel mixture in the engine which may be greater than or less than the desired air-fuel mixture and an error signal is generated which can be used to modify or correct the basic control signal in a closed loop manner for selectively adjusting throttle plate position to more precisely maintain a desired air-fuel ratio. While the present type of system has inherent acceleration enrichment since the fuel enters before the air flow increases, an undesirable condition of excessive enrichment may occur. The rate of change of commanded fuel flow is monitored to anticipate an impending undesirable condition of excessive enrichment and a transient control signal adjustment spike is generated to momentarily increase air flow to minimize the undesirable condition even before the gas detector or roughness sensor actually detects the existence of same. A closed loop governing system for metering the fuel flow may also be provided, if desired.

33 Claims, 5 Drawing Figures

MAP
RPM
FUEL PUMP.
INTAKE MANIFOLD.
ENGINE.
EXHAUST
AIR
FUEL
AIR IN
SERVO MOTOR.
DIFF.
INTEG.
COMP.
ECU
TEMP. AMB.
AMBIENT PRESSURE
Vref (2)
Vref (1)

FUEL DEMAND ENGINE CONTROL SYSTEM

BACKGROUND OF THE INVENTION

1. Field of the Invention

This invention relates to an electronic system for controlling the air-fuel mixture in an internal combustion engine and more particularly to a closed loop system for maintaining a desired air-fuel mixture in an internal combustion engine wherein the operator commands a given fuel flow and the control system adjusts air flow to maintain the desired air-fuel ratio.

2. Description of the Prior Art

In recent years, the importance of maintaining a desired or optimal air-fuel ratio in an internal combustion engine has been increasingly emphasized. Recent health and safety concerns aimed at lowering or eliminating pollution and the like have been enacted into federal, state and local laws regulating emission standards. Today's internal combustion engines, such as those used in automobiles and the like, must conform to those standards and must, under substantially all operating conditions, generate and emit no more than a predetermined amount of air pollutants such as carbon monoxide, noncombustible hydrocarbons, and various oxides of nitrogen.

Experience has shown that for each internal combustion engine, and for each set of conditions under which that engine operates, there exists certain desired air-fuel ratios which must be maintained for insuring optimal control over the generation and emission of pollutants. Similarly, it has been found that there also exists, for a given engine and for a given set of engine operating conditions, optimal air-fuel ratios which produce optimal drivability. Recent fuel shortages and the ever-increasing cost of fuel has caused increased concern, and more recently legislation has been enacted setting various miles per gallon standards for automobiles.

Therefore, the number of miles per gallon is one important aspect of drivability and another aspect relates to how responsive the internal combustion engine is to operator commands without stalling, sputtering, or producing engine roughness and the like.

Unhappily, there is, in many cases, a direct conflict between the optimal air-fuel ratio required for maintaining the minimal generation and emission of pollutants and the air-fuel ratio required for maintaining optimal drivability. Therefore, modern engines are usually required to select an air-fuel ratio which conforms to all regulations governing the generation and emission of pollutants while providing the optimal drivability possible under such circumstances.

In most internal combustion engines, an accelerator is provided which can be selectively positionable by the operator to command a given air flow by selectively positioning a throttle valve and then fuel is metered into the engine by any of several methods, as by carburators or fuel injectors or the like. In most systems designed for maintaining a predetermined air-fuel ratio, for example in U.S. Pat. No. 3,750,632 for an "Electronic Control for the Air-Fuel Mixture and for the Ignition of an Internal Combustion Engine," the quantity of metered or injected fuel is varied to maintain the desired air-fuel ratio. Such systems have many inherent problems including the need for some system of providing acceleration enrichment when the internal combustion engine is accelerating or some type of fuel enrichment during initial start and engine warm-up.

Relatively few systems, such as that shown in U.S. Pat. No. 3,983,848 for a "Fuel Injection System" allow the operator to command a given fuel flow and then control the flow of air to maintain a predetermined air-fuel ratio and most such systems require rather expensive and complex means for sensing the actual air flow in the engine intake and do not use some form of negative feed-back for correcting air flow to obtain a more precise control over the desired or optimal air-fuel ratio.

Still other systems, such as that illustrated in U.S. Pat. No. 3,738,341 for a "Device for Controlling the Air-Fuel Ratio in a Combustion Engine" are able to more accurately control air-fuel ratio by varying the quantity of injected fuel in accordance with a feed-back signal indicative of the level of carbon dioxide present in the exhaust system. While this is a relatively crude pollution control means, it does not possess the degree of sensitivity required for maintaining optimal drivability and the system must still provide some type of acceleration enrichment or the like.

The present invention does not require a separate acceleration enrichment system since it has inherent or automatic acceleration enrichment because the fuel flow commanded by the operator enters first and then the air flow increases.

The present invention avoids the problems and disadvantages of the prior art by providing a control system for selectively varying air flow in response to operator commanded fuel flow. Basic control is determined by various engine operating parameters including fuel flow and a closed loop system is provided for sensing a parameter indicative of the actual air-fuel mixture existing in the engine for adjusting or correcting the control to maintain the desired or optimal air-fuel ratio.

SUMMARY OF THE INVENTION

The closed loop system of the present invention controls the air-fuel mixture in an internal combustion engine so as to maintain a desired or optimal air-fuel ratio under most engine operating conditions. An accelerator means is responsive to operator command for supplying a predetermined quantity of fuel to the engine and means are provided for controlling the air flow into the engine. Means responsive to the accelerator means are provided for generating a first signal indicative of the quantity of supplied fuel and means responsive to the air flow control means generate a second signal indicative of the present actual air flow into the engine. Computing means are provided which is responsive to at least the first and second signals for generating a basic control signal for regulating the air flow control means. Means responsive to the actual air-fuel mixture existing in the engine are provided for generating the feed-back signal and means responsive to the feed-back signal are provided for correcting the basic control signal so that the air flow control means may be responsive thereto for selectively increasing and decreasing air flow into the engine to maintain a desired or optimal air-fuel ratio.

The system of the present invention possesses inherent or automatic acceleration enrichment, but if the accelerator means commands too rapid an increase in the fuel flow, an undesirable condition of excessive fuel enrichment may occur. In the preferred embodiment, means are provided for anticipating an impending condition of excessive fuel enrichment and for generating a transient correction signal to temporarily increase air flow into the engine even before the air-fuel mixture responsive means can generate the feed-back signal indicative of the actual existence of said condition so as to minimize said undesirable condition.

In the present invention, the means responsive to the actual air-fuel mixture existing in the engine for generating a feed-back signal includes a gas sensor (in the preferred embodiment, an oxygen sensor) but engine roughness sensing means or any similar means for providing a measure of the actual air-fuel mixture are also contemplated as being within the scope of the invention.

The invention also teaches an alternate embodiment which includes a fuel flow governing system wherein the accelerator means commands a given fuel flow and hence, a given engine speed, and maintains the desired engine speed by means of another closed loop control system.

The present invention also contemplates a closed loop method of maintaining a desired air-fuel ratio in an internal combustion engine comprising the steps of supplying a quantity of fuel to the engine under operator command, measuring a first parameter indicative of the actual air flow into the engine, controlling the air flow into the engine as a function of the quantity of fuel supplied to the engine under operator command and said measured parameter indicative of actual air flow into the engine, measuring an engine operating parameter indicative of the actual air-fuel mixture existing in the engine and selectively increasing and decreasing the controlled air flow in response to the measured engine operated parameter in a closed loop manner so as to maintain a desired or optimal air-fuel ratio under substantially all engine operating conditions. Again, the step of anticipating an impending undesirable condition of excessive fuel enrichment and increasing air flow to minimize same is contemplated in the preferred embodiment.

Since the system of the present invention has inherent acceleration enrichment, it is inherently more simple than many of the systems used today. Therefore, it avoids the problems associated with generating acceleration enrichment and the problems inherent in maintaining a desired air-fuel ratio during periods of acceleration enrichment.

Unlike those few systems of the prior art which commanded fuel flow and then electrically controlled air flow to maintain a desired air-fuel ratio, the present invention is not nearly as susceptible to undesirable conditions of excessive enrichment which occur whenever the commanded fuel flow is caused to increase too quickly or the like since means are provided for anticipating such an undesirable condition and for minimizing same.

The system of the present invention is able to more accurately and precisely control and maintain a predetermined optimal or desired air-fuel mixture since the feed-back signal, which in the preferred embodiment of the present invention is taken from an oxygen sensor in the exhaust system of the engine, it is used to adjust a basic or scheduled control signal in order to "fine tune" or correct or adjust the air flow to more accurately maintain and control the desired air-fuel ratio under substantially all engine operating conditions.

The method and apparatus contemplated by the preferred embodiment of the present invention provides a means for operating an internal combustion engine in a closed loop mode based upon various sensed engine operating parameters so as to accurately permit the engine to maintain a predetermined optimal or desired air-fuel mixture which can be selected to meet all pollution standards while providing the best possible drivability under such circumstances. The system of the present invention is relatively inexpensive, simple, easy to maintain, and provides a high degree of adherence to a desired or programmed air-fuel ratio, together with the superior engine smoothness and drivability inherent therein, heretofore unattainable or commercially unfeasable in the systems of the prior art.

Other advantages and meritorious features of the present invention will be more fully understood from the following detailed description of the drawings and the preferred embodiment, the appended claims and the drawings, which are briefly described hereinbelow.

DESCRIPTION OF THE PREFERRED EMBODIMENT

Figure 1:
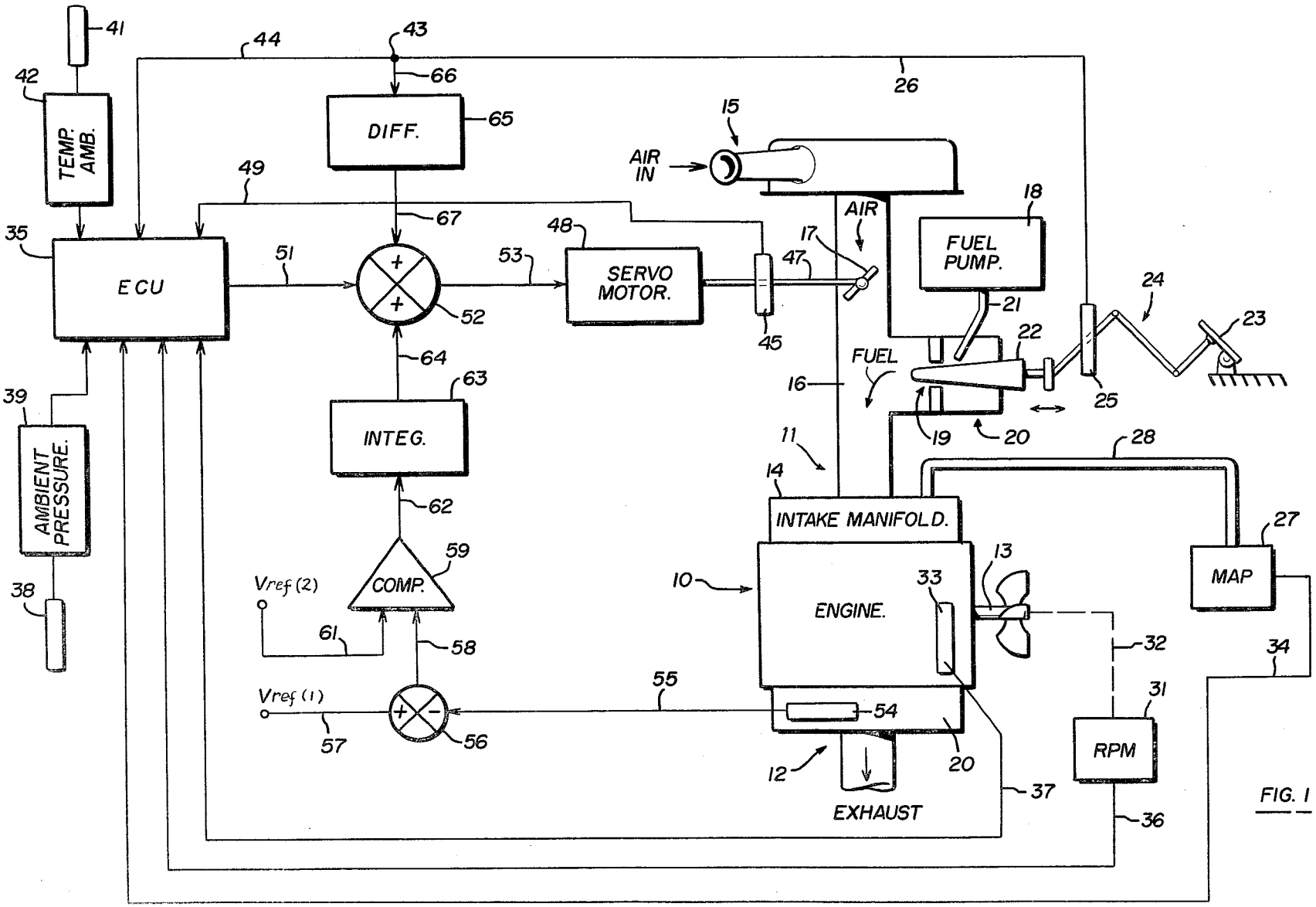
FIG. 1 is a block diagram illustrating the closed loop control system of the present invention.

FIG. 1 shows an internal combustion engine 10 having an intake system 11, an exhaust system 12 and an output shaft 13 which is operatively rotated by the combustion of fuel and air within the engine 10, as conventionally known.

The intake system 11 includes an intake manifold 14, an air inlet apparatus 15, and a throat or conduit 16 communicating the air inlet apparatus 15 with the intake manifold 14. A throttle valve 17, such as a conventional butterfly valve or the like, is operatively disposed within the throat 16 to control the flow of air between the air inlet apparatus 15 and the intake manifold 14 and therefore to the individual, conventionally known cylinders, not shown, but known in the art, for varying or controlling the air-fuel ratio or mixture within the intake system 11, or alternatively within the individual cylinders of the engine 10, as conventionally known.

A conventional fuel pump or fuel supply system 18 supplies fuel to an inlet means 19 in a fuel port assembly 20 via fuel conduit 21. A fuel metering rod 22 is at least partially disposed within the inlet 19 of the fuel inlet port 20 for controlling or metering via its position within the inlet 19 the quantity of fuel supplied from the conduit 21 through the inlet 19 and into the intake system 11.

An accelerator pedal 23 is provided which can be selectively positioned by the operator of the vehicle to command or positively control a predetermined fuel flow as hereinafter described. A linkage assembly 24 is operatively connected between the accelerator pedal 23 and a control end of the fuel metering rod 22 so as to selectively vary or adjust the position of the fuel metering rod within the fuel port 20 so as to control the quantity of fuel supplied by the fuel pump 18 and the conduit 21 through the inlet 19 and into the intake system 11 of the engine 10. Therefore, in the system of the present invention, the operator positively commands the quantity of fuel to be supplied to the internal combustion engine 10 by selectively positioning the accelerator 23 and thereby positively controlling the position of the fuel metering rod 22 via the linkage assembly 24.

A conventional positional transducing means 25 is operatively associated with a portion of the linkage assembly 24, or alternatively with the fuel metering rod 22, in order to sense the relative position thereof and generate a first electrical signal on lead 26 which is indicative of the relative position of one of the accelerator 23, the linkage assembly 24 or the fuel metering rod 22 and which is also, therefore, proportional to and indicative of the quantity of fuel commanded to be supplied to the intake system 11 through the inlet 19.

A means for sensing the manifold absolute pressure within the intake manifold 14 is represented by the block 27 which is operatively connected to the intake manifold 14 via conduit 28. The contents of the manifold absolute pressure detection system of block 27 is conventional and may be, for example, that shown in co-pending patent application Ser. No. 837,657 for a "Closed Loop Exhaust Gas Recirculation Control System" which was filed on Sept. 29, 1977 and which is assigned to the assignee of the present invention and which is incorporated by reference herein. It will, of course, be understood that, since the preferred embodiment of the present invention discloses a system which is primarily analog in nature, only the analog portion of the system disclosed in said co-pending case would be used although the system of the present invention could also be converted to digital form by following the teachings shown in said co-pending application and by similar conversion techniques known in the art.

Similarly, an engine speed sensing system or shaft position transducer is represented by block 31 which may be operatively associated with the output shaft 13 as indicated by the dotted line 32 so as to measure engine speed, RPM, shaft position, or any similar engine operating parameter, as known in the art. The block could, for example, contain the circuitry disclosed in the above referenced co-pending application or any type of conventional shaft position transducer capable of outputting an analog or digital signal indicative of engine speed or the like. Conventional D/A conversion techniques could be used if required.

A temperature transducer 33 is operatively associated with the engine 10 for measuring the engine temperature or alternatively, the temperature of the engine coolant, as conventionally known. Any type of temperature transducer capable of sensing the temperature in its immediate area and outputting a signal proportional to and indicative of said temperature may be employed.

The signal outputted from the MAP block 27 is a voltage proportional to and indicative of the actual absolute manifold pressure existing within the intake manifold 14 of the engine 10 and this signal is transmitted via lead 34 back to a conventional electronic control unit (ECU) 35 which senses various predetermined engine operating parameters and outputs a basic control signal in accordance with the sensed parameters for maintaining a desired schedule or program of air-fuel ratios.

The basic control unit or computing means 35 of the present invention is preferably of the type disclosed in U.S. Pat. No. 3,734,068 which issued to J. N. Reddy on May 22, 1973 for a "Fuel Injection Control System" and which is assigned to the assignee of the present invention, but any type of commercially available, conventional means, preferrably analog, but even digital, for computing or scheduling a control signal in accordance with various measured engine operating parameters may be used such as those disclosed in U.S. Pat. No. 3,750,632 entitled "Electronic Control for the Air-Fuel Mixture and for the Ignition of an Internal Combustion Engine"; U.S. Pat. No. 3,763,720 for a "Shift Shock Preventive Device for Motor Vehicle Fuel Injection System"; U.S. Pat. No. 3,969,614 for a "Method and Apparatus for Engine Control"; and U.S. Pat. No. 3,986,006 for a "Fuel Injection Controlling for an Internal Combustion Engine." All of these patents utilize some form of analog or digital control unit or computing means which could be readily adapted for performing the functions required of the ECU 35 for implementation of the present invention and all are incorporated by reference herein. Still further, the relatively simple analog implementation of the circuit of FIG. 3 could also be used to implement the necessary control function of the present invention.

A signal indicative of the engine speed is supplied from block 31 to another input of the ECU 35 via lead 36 and the output of the temperature transducer 33 is supplied to yet another input to the ECU 35 via lead 37. The ECU 35 may also be provided with a signal proportional to and indicative of ambient atmospheric pressure, as measured by a conventional pressure transducer 38 whose output is supplied via the ambient pressure measurement circuitry of block 39 to yet another input of the ECU 35, if required. Additionally, information regarding ambient temperature may be supplied to the ECU 35 via another temperature transducer 41 which measures ambient temperature and supplies a signal or voltage proportional to and indicative of the ambient temperature to yet another input of the ECU 35 via the circuitry of block 42.

Still another input of the ECU 35 receives the first signal outputted from the position sensing transducer 25 which is indicative of the commanded fuel flow via lead 26, node 43 and lead 44. Lastly, the ECU 35 receives information concerning the present or current actual air flow into the engine 10 from a conventional positional transducer 45 which is operatively associated with the actuator means 47 through which a conventional DC servo motor 48 selectively adjusts the position of the throttle valve 17 or directly with the throttle valve 17 or motor 48 itself so as to output a voltage proportional to and indicative of the present position of the throttle valve 17 and hence indirectly of the present actual air flow into the intake manifold 14. This signal indicative of present air flow is transmitted from the positional sensor 45 back to the yet another input of the ECU 35 via lead 49.

In the preferred embodiment of the present invention, the ECU 35 receives at least the input information concerning the commanded fuel flow from transducer 25 and the information indicative of the present position of the throttle valve 17 and hence of the present air flow, and any of the other engine operating parameters MAP, RPM, engine temperature, coolant temperature and the like and various other parameters such as atmospheric pressure and ambient temperature and the like which may be required, and computes or determines a basic control signal which it generates and outputs via lead 51. The basic control signal is indicative of the desired or scheduled position of the throttle valve to adjust the air flow so as to maintain a predetermined scheduled or preprogrammed air-fuel mixture. The basic control signal is supplied through an error correction or summing network 52 wherein it may be adjusted or corrected and then the corrected control signal is supplied via lead 53 to control the operation of a conventional DC servo motor 48 which adjusts the position of the throttle valve 17 via servo motor actuator means 47, as known in the art.

As presently described, the operator of the vehicle or the person controlling the operation of the internal combustion engine 10 commands a predetermined fuel flow by manually positioning the accelerator pedal 23 to position the fuel metering rod 22 so as to admit a predetermined quantity of fuel into the intake manifold 14. A signal indicative of the quantity of fuel commanded is supplied back to the ECU 35 via lead 26, node 43 and lead 44 and ECU 35 also receives information indicative of the present position of the throttle valve 17 and hence of current air flow into the system via lead 49. ECU 35 may also receive information relating to other engine operating parameters as heretofore described, if desired. The ECU 35 responds to the current engine operating parameters and to the signal indicative of the fuel supply currently being commanded and generates a basic control signal via lead 51, circuit 52 and lead 53 which causes the servo motor 48 to adjust the position of the throttle valve 17 so as to selectively open or close the valve to increase or decrease air flow so as to maintain a predetermined scheduled pre-programmed or desired air-fuel ratio as determined by the circuitry or programming of the ECU 35, as conventionally known.

The system of the present invention, however, further provides a closed loop for fine tuning or correcting the basic control signal so as to insure that the servo motor 48 more accurately positions the throttle valve 17 to continuously supply the required air flow for maintaining the desired or optimal air-fuel mixture within the engine 10. The closed loop feed-back system of the present invention includes sensing means 54 responsive to the actual air-fuel mixture existing within the engine 10 for supplying a feed-back signal indicative thereof back to the correction circuitry of block 52 for correcting or adjusting the basic control signal to more accurately position the throttle valve and more precisely control air flow.

In the preferred embodiment of the present invention, the sensing means is a conventional gas sensor such as that disclosed in U.S. Pat. No. 4,005,689 for a "Fuel Injection System Controlling Air-Fuel Ratio by Intake Manifold Gas Sensor" which is assigned to the assignee of the present invention and which is incorporated by reference herein. In the preferred embodiment, the gas sensor is an oxygen sensing transducer 54 which transmits an analog signal or voltage via lead 55 back to a summing network 56. At the summing network 56, which is a conventional analog adder/subtractor, the value of the signal on lead 55 is subtracted from a first reference signal supplied to the adder/subtractor 56 via lead 57, where the value of the reference voltage is selected so that the output of the adder/subtractor 56 is proportional to the variation of the quantity of oxygen sensed in the exhaust system 12 from stoichiometric. This difference signal indicative of the variation from stoichiometric is supplied via lead 58 to one input of a comparator 59 whose other input is coupled via lead 61 with a second reference voltage which is established so that the output of the comparator 59 has a first sign whenever the oxygen sensing means 54 determines that the engine 10 is operating below the stoichiometric air-fuel ratio and another polarity signal when the oxygen sensor 54 detects that the engine is operating above the stoichiometric air-fuel ratio. The output of the comparator 59 may be supplied via lead 62 to the input of an integrating circuit represented by block 63. The integrator output is connected via lead 64 to a summing input of the circuitry of block 52 so that the feed-back signal from the integrator 63 may be algebraically added to the basic control signal on lead 51 so as to fine tune or correct the basic control signal to more accurately control the operation of the servo motor 48 and therefore the positioning of the throttle valve 17 for more accurately controlling air flow and therefore more precisely maintaining a desired or optimal air-fuel ratio within the engine 10.

Therefore, the system of the present invention responds to a commanded fuel flow determined by the position of the accelerator 23 and to various other actual engine operating parameters and the ECU 35 computes a basic control signal for controlling the operation of a DC servo motor 48 which controllably positions the throttle valve 17 for controlling air flow. The actual air-fuel mixture existing in the engine 10 is measured, via the oxygen sensor 54, to supply a feed-back signal for correcting the basic control signal in a closed loop manner so that the corrected control signal supplied via lead 53 to the servo motor 48 allows a more precise or accurate positioning of the throttle valve and enables the system of the present invention to more accurately maintain a predetermined desired or optimal air-fuel ratio under substantially all engine operating conditions.

As previously described, the sensing means 54 is, in the preferred embodiment of the present invention, a gas sensor for sensing the content of oxygen or the relative content of oxygen in the exhaust system 12 of the engine 10 as a measure of the actual air-fuel mixture existing within the engine 10. Alternatively, the sensing means 54 could be a means for sensing engine roughness, since engine roughness is generated by excessively high or low air-fuel ratios. Therefore, the invention also contemplates that the sensing means 54 or means associated with RPM block 31 could alternatively be a means for sensing engine roughness and generating a signal proportional to and indicative of engine roughness as an indicator of the actual air-fuel ratio or mixture existing in the engine 10. For example, the roughness sensing means disclosed in the commonly assigned U.S. Pat. Nos. 3,789,816 and 3,872,846 could be used for generating the required signal indicative of engine roughness and these patents are incorporated by reference herein.

As previously stated, most of the systems of the prior art wherein the air flow is controlled by operator command and the fuel flow is controllably adjusted for maintaining a desired air-fuel ratio suffer from the problem that additional circuitry is usually required to provide for acceleration enrichment. This problem never exists with the system of the present invention since it has the advantage of automatic or inherent acceleration enrichment since the fuel enters the intake system 11 first and then the air flow is adjusted in response thereto.

However, a problem can occur when the accelerator 23 is rapidly depressed to command a rapid increase in the quantity of fuel supplied to the intake system 11. In this case, too great a quantity of fuel will be supplied to the intake system 11 before the oxygen sensing means 54 is able to feed back a correction signal to the servo motor 48 for supplying additional air with the result that an undesirable condition of excessive fuel enrichment will exist in the engine 10.

The present invention provides a differentiator network 65 for eliminating or at least minimizing this problem. In operation, the input to the differentiator circuit of block 65 is connected via lead 66 to node 43 for monitoring or receiving the first signal indicative of commanded fuel flow therefrom. The output of the differentiator is connected via lead 67 to another summing input of the circuit of block 52 for correcting or supplementing the basic control system supplied thereto via lead 51 as described later in detail.

In brief, the differentiator of block 65 monitors the rate of change of the signal indicative of the commanded fuel flow and responds to a rapid increase in commanded fuel flow to output a transient voltage spike correction signal which is added to the basic control signal in summing network 52 and supplied via lead 53 to adjust operation of the servo motor 48 to open the throttle valve 17 to immediately and momentarily increase the air flow to the engine 10 even before the oxygen sensor 54 is able to detect the actual existence of the excessive enrichment condition so as to eliminate or at least minimize the extent and duration of the undesirable condition of excessive enrichment. Since the voltage spike is a transient signal, it quickly dissipates to restore control of the servo-actuated throttle to the basic control signal and feed-back signal so that correction for any actual excessive enrichment can be made in the normal manner. However, the differentiator enables the system to anticipate or predict an impending undesirable condition of excessive fuel enrichment and generate a corrective signal for minimizing the effects thereof.

Figure 2:
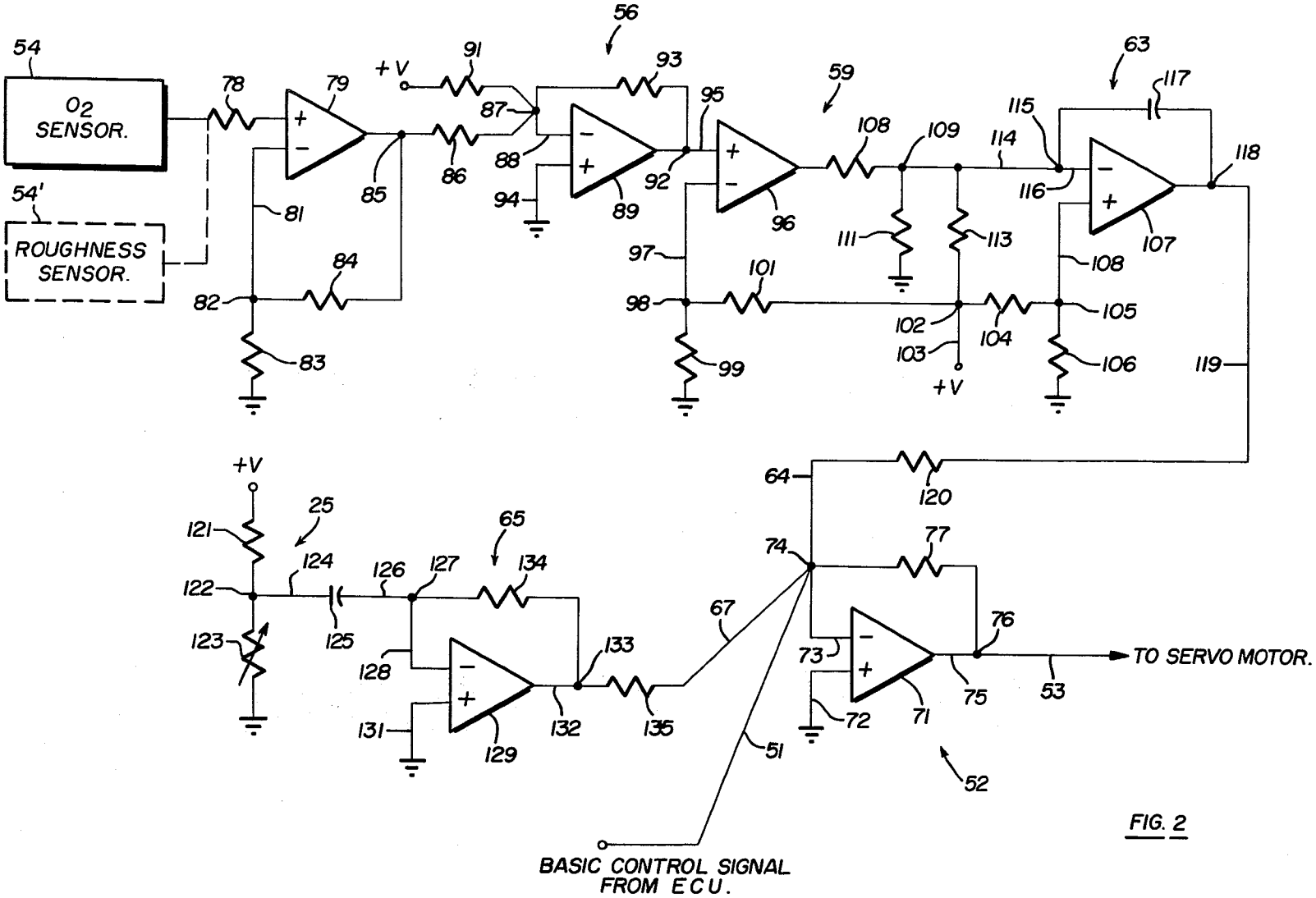
FIG. 2 is a schematic diagram of the anticipation circuitry, closed loop control circuitry and error correction circuitry of FIG. 1.

FIG. 2 is a schematic diagram of the feed-back loop comprising the gas sensing means 54, adder/subtractor 56, comparator 59 and integrator 63; the differentiator of block 65; and the summing network of block 52 of FIG. 1. The summing network 52 includes an operational amplifier 71 having its non-inverting input directly connected to ground via lead 72 and its inverting input connected via lead 73 to a common summing node or junction 74. The output of the operational amplifier 71 is connected via lead 75 to an output node 76 and the output node 76 is connected via lead 53 to the input of the servo motor of block 48 to control the operation thereof. A feed-back resistor 77 has one end connected to summing node 74 and its opposite end connected to the output node 76 so as to establish a conventional analog adder or summing circuit wherein each of the signals supplied to the summing node 74 are algebraically added to the other and then amplified or scaled to produce an output signal proportional thereto which is supplied via lead 53 to the servo motor 48.

The basic control signal from the ECU 35 is connected via lead 51 to the common summing node 74 and provides the basic or primary input to the operational amplifier 71. This basic control signal is used to operate or control the operation of the DC servo motor 48 to selectively vary the position of the throttle valve 17, as conventionally known. As previously described, the basic control signal on lead 51 can be corrected or adjusted via the feed-back signal or voltage spike transient correction signal so as to provide a finely tuned or corrected control signal at the output which is supplied to the control input of the DC servo motor 48 via lead 53, as previously described.

The feed-back loop of the present invention includes the gas sensor 54 or, alternatively, the roughness sensor of block 54'. The output of the oxygen sensor 54 or roughness sensor 54' is a signal generally representative of the actual air-fuel mixture existing within the internal combustion engine 10 and this signal is supplied through a resistor 78 to the non-inverting input of an operational amplifier 79. The inverting input of the operational amplifier 79 is connected via lead 81 to a node 82. Node 82 is a tap of a voltage divider network and is connected to ground through a first voltage divider resistor 83 and through a resistor 84 to output node 85. The output of the operational amplifier 79 is taken from output node 85 and the configuration of the operational amplifier 79 together with resistors 78, 83 and 84 establishes a buffer stage or scaling circuit for adjusting the level of the output signal as required for the signal level needs of the present system.

Output node 85 is connected through a resistor 86 to a summing node 87. Summing node 87 is connected via lead 88 to the inverting input of an operational amplifier 89. The summing node 87 is also connected to a source of positive potential through a resistor 91 and to the output 92 of the amplifier 89 via resistor 93. The non-inverting input of the operational amplifier 89 is connected directly to ground through lead 94. The amplifier 89 together with resistors 86, 91 and 93 are configured to form a conventional analog adder-subtractor or summing circuit wherein a reference signal indicative of a stoichiometric air-fuel mixture is summed with the negative of a scaled signal indicative of the actually existing air-fuel mixture in the engine 10 so that the signal appearing at the output node 92 represents the variation of the actual air-fuel mixture existing in the engine from stoichiometric.

Output node 92 is connected via lead 95 to the non-inverting input of an operational amplifier 96 whose inverting input is connected via lead 97 to voltage divider node 98. Node 98 is connected to ground through a resistor 99 and through a voltage divider resistor 101 to a second node 102. Node 102 is connected directly to a source of positive potential through lead 103 and through another voltage dividing resistor 104 to voltage divider node 105. Node 105 is connected to ground through a resistor 106 and to the non-inverting input of an operational amplifier 107 via lead 108. The output of the operational amplifier 96 is supplied through a resistor 108 to a node 109 which is also connected to ground through a resistor 111. The operational amplifier 96 together with resistors 99 and 101 form an analog comparator. The reference voltage is provided to the non-inverting input via the lead 97 from the voltage divider comprising resistors 99, 101 and node 98. This reference voltage is established so that a first polarity output will be supplied at the output of operational amplifier 96 if the input signal on lead 95 indicates an air-fuel mixture which is less than stoichiometric and of an opposite polarity when the signal on lead 95 indicates an air-fuel mixture which is more than stoichiometric.

Node 109 is also connected through a resistor 113 to voltage input node 102 and via lead 114 to input node 115. Node 115 is connected to the inverting input of the operational amplifier 107 via lead 116 and to an integrating capacitor 117 which is connected between the input node 115 and the output node 118 of the operational amplifier 107 so as to form a standard analog integrator.

The integrator 63, comprising the operational amplifier 107, integrating capacitor 117, and the various resistors 108, 109, 104 and 105 will integrate the comparator output signal and transmit a feed-back signal via lead 119 resistor 120 and lead 64 back to the common summing node 74 so as to enable the output of the integrator 63 to controllably adjust or correct the value of the basic control signal to fine tune the signal commanding the operation of the servo motor 48 as previously described.

The system for anticipating an impending undesirable condition of excessive fuel enrichment will now be described. The positional sensor 25 of FIG. 1 is represented as a voltage divider configuration wherein a first voltage divider resistor 121 has one end connected to a source of positive potential and its opposite end connected to a voltage divider node 122. Node 122 is connected to ground through a variable resistor 123 whose value is changed in a conventional potentiometer fashion as the position of the accelerator 23, linkage 24, and/or fuel metering rod 22 is changed by the operator's command.

The voltage signal present at node 22 is indicative of the commanded fuel flow and is supplied via lead 124 to one plate of a differentiating capacitor 125 whose opposite plate is connected via lead 126 to input node 127. Node 127 is connected via lead 128 to the inverting input of an operational amplifier 129 whose non-inverting input is connected directly to ground through lead 131. The output of operational amplifier 129 is connected via lead 132 to an output node 133 and a feedback resistor 134 has one end connected to the input node 127 and its opposite end connected to the output node 133 so that the combination or configuration of the operational amplifier 129, capacitor 125 and resistor 134 forms a conventional analog differentiator circuit capable of differentiating the signal indicative of the commanded fuel flow for monitoring the rate of change thereof. The output node 133 is connected through a resistor 135 to lead 67 which supplies the second correction signal or differentiated signal to the common summing node 74.

In operation, the anticipation or prediction of an impending undesirable condition of excessive fuel enrichment occurs as follows. Whenever the operator commands a rapid increase in the quantity of fuel to be metered into the intake system 11 of the engine 10, as by rapidly depressing the accelerator pedal 23, the voltage signal outputted from the position sensor 25 will rapidly increase. The differentiator circuit 65 differentiates this signal and monitors the rate of change or rapid increase therein for outputting a voltage spike or transient signal which quickly rises and then falls. This transient voltage spike is supplied to the summing node 74 and immediately modifies the basic control signal to be transmitted via lead 53 to the DC servo motor of block 48 to momentarily and immediately adjust the position of the throttle valve 17 so as to temporarily increase the air flow into the intake system 11. As soon as the voltage spike dissipates, the control of the servo motor is restored to the basic control signal on lead 51 and the feed-back signal coming from lead 64 so that even if the impending undesirable condition is not entirely avoided, the gas-sensing feed-back means will enable the appropriate correction to be made so as to enable the system to quickly restore and accurately maintain the desired air-fuel ratio.

Figure 3:
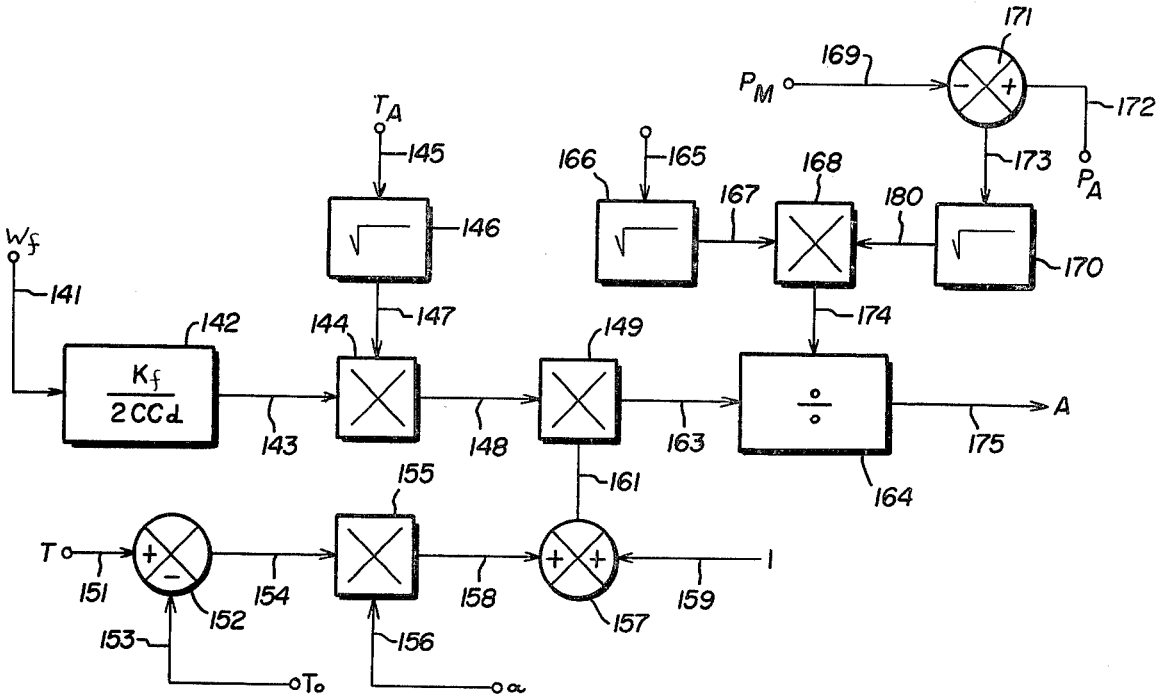
FIG. 3 is a block diagram illustrating an alternate analog implementation of the electronic control unit of block 35 of FIG. 1.

FIG. 3 shows a block diagram of a relatively simplistic implementation of the basic control function of the ECU 35 of FIG. 1 as used in the system of the present invention. The air flow control signal "A" may be obtained from the equation $$\frac{W_f K_f (1 + a(T - T_0)) \sqrt{T_A}}{2C\, C_d \sqrt{P_m}\ \sqrt{P_A - P_m}} = A$$

where $W_f$ represents the fuel flow; $K_f$ is a constant approximately equal to the desired air-fuel ratio; T represents the actual engine temperature; $T_O$ represents a constant reference temperature such as a "cold start" threshhold; $T_A$ represents the ambient air temperature; C represents a gas flow constant; $C_d$ represents the discharge co-efficient for the particular throttle valve; $P_m$ equals the absolute manifold pressure of the engine; $P_a$ represents ambient atmospheric pressure; and A represents the area of the throttle opening which is a measure of air flow into the engine. Appropriate scaling can be used to appropriately modify the control parameter "A" to enable it to be used for directly controlling the operation of the DC servo motor 48 to position the throttle valve as required to satisfy the equation for a predetermined desired or optimal air-fuel mixture within the engine.

In the block diagram of FIG. 3, the signal $W_f$ which represents fuel flow can be taken as a measure of the fuel flow commanded by the accelerator 23 and measured via sensor 25. This signal is supplied via input 141 to a block 142 which implements the constant $K_f/2CC_d$ and the resulting value $W_f K_f/2CC_d$ which is itself a constant is supplied via lead 143 into one input of the analog multiplier of block 144. The ambient air temperature, as measured by the sensor 41 is supplied via lead 145 to the analog-implemented square root circuit of block 146 so that the square root of the ambient temperature is supplied via lead 147 to the other input of the analog multiplier 144. The product $$\frac{W_f K_f \sqrt{T_A}}{2CC_d}$$

is supplied via lead 148 to the first input of the analog multiplier of block 149.

The engine temperature, as measured by the temperature sensor 33, is supplied via lead 151 to the plus input of an analog summing circuit 152 and the temperature constant $T_O$ is supplied via lead 153 to a subtractive input thereto so that the difference $T-T_O$ is provided at the output of the summing circuit 152 and is supplied via lead 154 to the first input of the analog multiplier of block 155. The other input of the analog multiplier of block 155 is supplied with a constant "a" via lead 156 and the product $a(T-T_O)$ is presented to one input of an analog summing circuit 157 via lead 158. Another input of the summing circuit 157 is provided with a voltage representing the number "1" via lead 159 and the output $1+a(T-T_O)$ is supplied via lead 161 to the second input of the analog multiplier 149 so that the product $$\frac{W_f K_f 1 + a(T - T_0)}{2CC_d}$$

is supplied via lead 163 to the dividend input of a conventional analog divider circuit 164.

The absolute manifold pressure $P_m$ is sensed by the sensing means of block 27 of FIG. 1 and is provided via lead 165 to the analog-implemented square root circuitry of block 166 so that the square root of $P_m$ is supplied via lead 167 to one input of the analog multiplier of block 168. Simultaneously, the signal $P_m$ is supplied via lead 169 to the subtractive input of an analog summing circuit 171 which also receives the positive signal $P_a$ from the ambient pressure sensor 38 of FIG. 1 via lead 172. Hence, the output of the summing circuit 171 is the difference $P_a - P_m$ and this quantity is supplied via lead 173 to the input of a square root circuit 170. The output of block 170 is supplied via lead 180 to the second input of the analog multiplier of block 168. The analog multiplier 168 multiplies the signals present at its inputs and produces the product $P_m P_a - P_m$ at its output and this product is supplied via lead 174 to the divisor input of the analog divider of block 164 so that the signal A is outputted from the divisor circuitry of block 164 via lead 175 and can be used or scaled and then used to drive the DC servo motor 48 for accurately positioning the throttle valve 17 in accordance with the given parameters to maintain a scheduled or pre-programmed air-fuel mixture in the engine in accordance with a schedule determined by the various constants utilized in establishing the analog network of FIG. 3.

Each of the blocks used in FIG. 3 is a conventional analog circuit and may be purchased as "off the shelf" items from any number of sources such as from any Burr-Brown catalog. A standard scaling circuit using operational amplifiers and resistors can be used to implement the function present at the output of block 142; conventional analog summing circuits using operational amplifiers can be used to construct the adder/subtractor circuits 152, 157 and 171; conventional analog square root circuits can be used to perform the functions of blocks 146, 166 and 170; conventional analog multipliers can be used to implement blocks 144, 149 and 168 and a conventional analog divider can be used to implement the function of block 164. Alternatively, a conventional multifunction converter for implementing all required analog circuit functions, such as the Burr-Brown 4301 and 4302 circuits which implement the transfer function $E_O = V_y (V_z/V_x)^m$ can be used to implement all of the circuits required for building the system of FIG. 3. Alternatively, the circuits required for implementing the system of FIG. 3 can be found in any standard text book on operational amplifiers such as "An Introduction to Operational Amplifier" by Lucas M. Faulkenberry, which is published by John Wiley & Sons, New York, N.Y., 1977, or "Modern Operational Circuit Designs," by John I. Smith, published by Wiley-Interscience, New York, New York, 1971.

Figure 4:
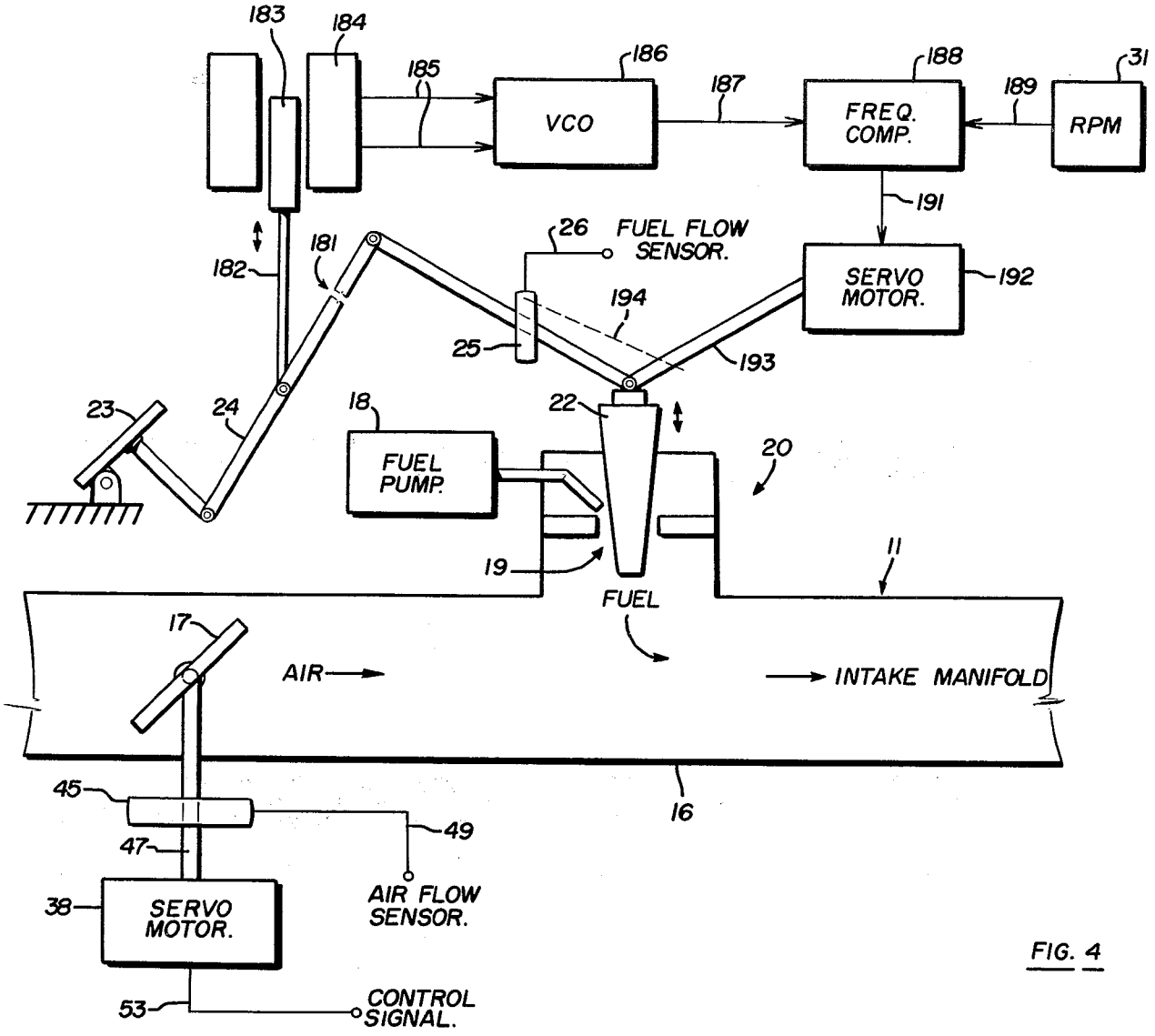
FIG. 4 is a block diagram illustrating the closed loop fuel control governing system which may be used with the system of the present invention.

FIG. 4 represents an alternate embodiment of the means for commanding fuel flow and represents a governing system wherein the positioning of the accelerator pedal 23 positively controls the positioning of a linkage system 24 for directly controlling the positioning of a fuel metering rod 22 within the inlet 19 of a fuel inlet port 20 as previously described to control the flow of fuel from the conduit 21 through the inlet 19 and into the intake system 11 of the engine 10. As represented by the break 181 in the linkage assembly 24, the accelerator pedal 23 may be used to directly and positively control the positioning of the fuel metering rod 22 or, as hereinafter described, it can be used to allow positive control plus indirect closed loop control of the fuel metering rod 22 or the positive control may be eliminated and a closed loop fuel control system established without positive control.

To establish the closed loop control, a linkage member 182 having one end operatively coupled to the linkage 24, has its opposite end operatively connected to a rod-like element or member 183 which is movably disposed within the hollow central core of electromagnetic coil means 184. The electromagnetic coil means 184 is configured such that the vertical positioning of the element 183 within its hollow central core determines the level or magnitude of the voltage signal present on its output leads 185. The output voltage is, therefore, proportional to the accelerator commanded fuel flow desired by the operator and is supplied to the inputs of a conventional voltage controlled oscillator 186 which produces an oscillating signal or waveform having a predetermined frequency controlled by the magnitude of the voltage present on input leads 185 and therefore a frequency which is indicative of the operator commanded fuel flow.

The output waveform whose frequency is indicative of commanded fuel flow is supplied via lead 187 to one input of a conventional frequency comparator 188 whose other input is supplied with a second signal waveform via lead 189. The second signal waveform has a frequency which is indicative of the engine speed such as may be produced by the conventional RPM circuitry of block 31 of FIG. 1 previously described. The frequency comparator 188 outputs a signal which is indicative of the difference between the actual engine speed and the commanded or desired engine speed, since from the standpoint of the operator, commanded fuel flow is proportional to desired engine speed, and this signal is supplied either directly or through a conventional integrator circuit via lead 191 to control the operation of a conventional DC servo motor 192.

The servo motor 192 operates an actuator member 193 which may be used to control the positioning of the fuel metering rod 22 within the inlet 19 to control the quantity of fuel supplied to the intake system 11 either alone or in conjunction with the positive control of linkage 24. The closed loop system of FIG. 4 is closed on engine speed since a signal whose frequency is indicative of actual engine operating speed is supplied or fed back to the control circuitry of block 188 to drive the DC servo motor 192 which makes a desired correction in the positioning of the fuel metering rod 22 until the operator commanded fuel flow, and hence engine speed, is attained.

As indicated by the dotted line 194, the fuel flow measuring means or position transducer 25 may be operatively coupled to the actuator 193 to obtain a positional measurement indicative of the commanded fuel flow instead of to the linkage system 24 or the fuel metering rod 22 as previously described. In all other respects, the system of FIG. 4 could be used to supplement the system of FIG. 1 if a governing system were desired or if it were desired to provide operator commanded fuel flow without a direct positive control linkage between the accelerator 23 and the fuel metering rod 22.

Figure 5:
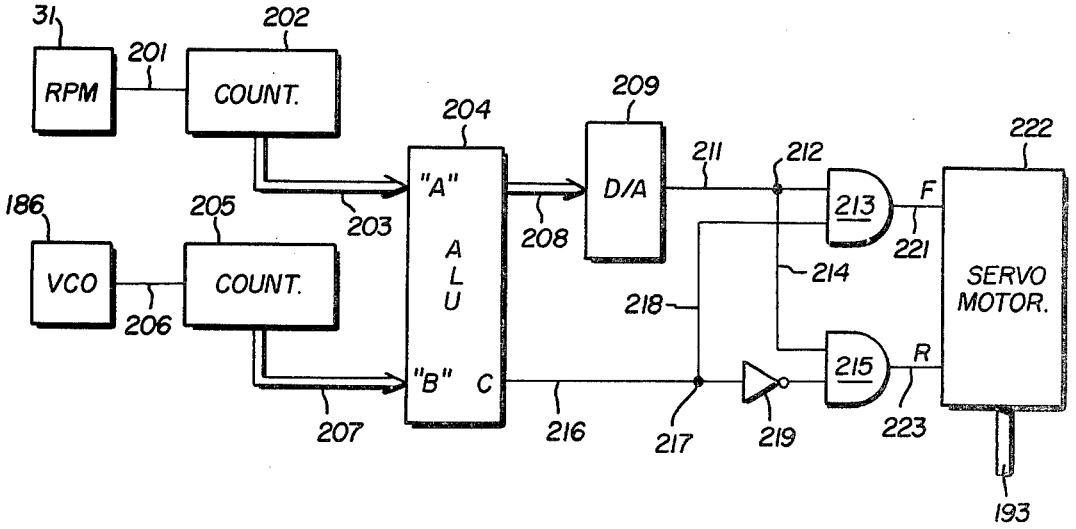
FIG. 5 is a block diagram illustrating an alternate embodiment of the circuitry of block 188 of FIG. 4.

FIG. 5 illustrates an alternate embodiment to the means for controlling the operation of the servo operated actuator 193 for positioning the fuel metering element 22 of FIG. 4 to maintain the operator commanded fuel flow or engine speed. In FIG. 5, a conventional RPM measuring system, such as one geared to count timing pulses located on a movable element, such as a pulley attached to the output shaft 13 of the engine 10, and these pulses are supplied via lead 201 to a conventional binary counter 202. At predetermined intervals, the digital number stored in the counter 202 may be transferred in parallel via data path 203 to the "A" input of an arithmatic logic unit 204. The voltage controlled oscillator 186 supplies a series of pulses to a second binary counter 205 via lead 206 and at said predetermined periodic interval, the binary number stored within the counter 205 may be transferred via data path 207 to the "B" input of the ALU 204.

The arithmatic logic unit 204 is a conventionally available unit which outputs a digital number indicative of the magnitude of the difference between the numbers present at the "A" and "B" inputs via data path 208 to a digital to analog converter 209. The output of the D/A converter 209 is supplied via lead 211 to a node 212 and from node 212 directly to a first input of a first logical AND gate 213 and via lead 214 to the first input of a second logical AND gate 215. Therefore, the pulse width or duration of the signal present at the first input of the AND gates 213, 215 is indicative of the magnitude of the difference between the actual and desired engine speeds and hence representative of the magnitude of the correction to be made.

The carry output of the ALU 204 is supplied via lead 216 to a node 217. Node 217 is connected via lead 218 to the second input of logical AND gate 213 and directly to the input of an inverter 219 whose output is connected directly to the second input of the second logical AND gate 215. Since the signal present at the carry output indicates whether the signal present at the "A" input is greater than or less than the signal present at the "B" input, AND gate 213 will be enabled whenever the desired engine speed is greater than the actual engine speed while the second AND gate 215 will be enabled whenever the actual engine speed is greater than the desired engine speed. The output of AND gate 213 is connected via lead 221 to the forward drive input of a conventional forward-reverse servo motor 222 while the reverse input is connected to the output of the second AND gate 215 via lead 223. Therefore, the servo actuator member 193 which controls the position of the fuel metering rod 22 will be driven in the forward direction whenever AND gate 213 is enabled and in the reverse direction whenever AND gate 215 is enabled and in either case, the amount which the actuator member 193 is turned will be determined by the pulse width or duration of the pulse outputted from the D/A converter 209. It will, of course, be realized that any suitable type of comparator means could also be used to implement the closed loop fuel metering system of FIG. 4.

As described herein, the method and apparatus of the present invention enables the air flow to be controlled in response to operator commanded fuel flow. Various engine operating parameters are measured to generate a control signal designed to maintain a predetermined scheduled or preprogrammed air-fuel mixture within the engine and a feed-back signal generally indicative of the actual air-fuel mixture existing within the engine, such as from an oxygen sensor disposed in the exhaust manifold, can be used to correct the basic control signal to provide an extremely accurate means for maintaining a desired or optimal air-fuel schedule under substantially all engine operating conditions. Anticpation circuitry may be employed to anticipate an impending undesirable condition of excessive enrichment and for generating a transient corrective signal which can be used to provide additional air flow into this system even before the feed-back system can sense the actual existence of the undesirable condition within the engine to minimize the undesirable condition of excessive enrichment.

With this detailed description of a specific circuit used to illustrate the preferred embodiment of the present invention and the operation thereof, it will be obvious to those skilled in the art that various modifications can be made in the circuitry and means for implementing the method and apparatus of the present invention without departing from the spirit and scope of my invention which is limited only by the appended claims.

I claim:

1. A closed loop system for controlling the air-fuel mixture in an internal combustion engine comprising:

accelerator means for supplying a quantity of fuel to said internal combustion engine;

means responsive to said accelerator means for generating a first signal indicative of said quantity of supplied fuel;

means for controlling the flow of air into said internal combustion engine;

means responsive to said air flow control means for generating a second signal indicative of the actual air flow into said engine;

control signal-computing means responsive to at least said first and second signals for generating a basic control signal for regulating said air flow control means, said basic control signal commanding a desired air flow as a function of the quantity of fuel supplied to the engine;

means responsive to the actual air-fuel mixture existing in said engine for generating a feed-back signal indicative thereof; and means responsive to said feed-back signal for correcting said basic control signal, said air flow control means being responsive to said corrected control signal for selectively increasing and decreasing the air flow into said engine to maintain a desired optimal air-fuel ratio under substantially all engine operating conditions.

2. The closed loop system of claim 1 further including means responsive to said first signal for anticipating an impending undesirable condition of excessive fuel enrichment and for generating a second correction signal, said means responsive to said feed-back signal also being responsive to said second correction signal for modifying said basic control signal to temporarily increase the air flow to said engine even before said air-fuel mixture responsive means can generate said feed-back signal indicative of the existence of said undesirable condition so as to minimize the extent of said undesirable condition.

3. The closed loop system of claim 1 further including means responsive to said first signal for monitoring the rate of change thereof and for generating a second correction signal indicative of a rapid increase therein which corresponds to a prediction of an impending excessive enrichment condition, said correcting means being responsive to said second correction signal for modifying said basic control signal even before receiving said feed-back signal indicative of the existence of said undesirable condition, said air flow control means being responsive to said modified control signal for temporarily increasing the air flow into said engine for minimizing the degree and duration of said predicted excessive enrichment condition.

4. The closed loop system of claim 3 wherein said means for monitoring the rate of change of said first signal and for generating said second correction signal includes means for computing the first derivative of said first signal, said derivative appearing as a voltage spike waveform whenever a rapid increase in said first signal is detected, said rapid increase in said first signal being indicative of an impending excessive enrichment condition within said engine, said correcting means and said air flow control means being responsive to said spike waveform for immediately and temporarily increasing air flow and then restoring control of said air flow control means to said basic control signal as corrected by said feed-back signal when said voltage spike waveform dissipates.

5. The closed loop system of claim 1 wherein said means for controlling the flow of air into said internal combustion engine includes a throttle valve disposed in the intake system of said engine and servo motor means responsive to said control signals for varying the position of said throttle valve to selectively increase and decrease said air flow into said internal combustion engine.

6. The closed loop system of claim 5 wherein said means for generating said second signal includes transducer means operatively associated with one of said servo motor means and said throttle valve for generating an electrical signal indicative of the relative position thereof, said electrical signal corresponding to said second signal and being proportional to and indicative of the actual air flow into said internal combustion engine.

7. The closed loop system of claim 1 wherein said acceleration means includes:

a manually positionable accelerator for positively commanding the quantity of fuel to be supplied to said internal combustion engine;

a fuel inlet into said internal combustion engine;

means for supplying fuel to said fuel inlet;

a fuel metering rod disposed at least partially within said inlet for regulating the passage of fuel therethrough; and linkage means operatively coupled between said accelerator and said fuel metering rod for selectively varying the position thereof so as to positively regulate the quantity of fuel supplied to said engine.

8. The closed loop system of claim 7 wherein said means for generating said first signal includes transducer means operatively associated with one of said fuel metering rod and said linkage means for generating an electrical signal indicative of the relative position thereof, said electrical signal corresponding to said first signal and being proportional to and indicative of the quantity of fuel which the operator has commanded to be supplied to said engine.

9. The closed loop system of claim 1 wherein said means responsive to the actual air-fuel mixture within said internal combustion engine includes gas sensing means.

10. The closed loop system of claim 9 wherein said gas sensing means includes an oxygen sensing element disposed within the intake system of said internal combustion engine.

11. The closed loop system of claim 9 wherein said gas sensing means includes an oxygen sensing element disposed within the exhaust system of said internal combustion engine.

12. The closed loop system of claim 1 wherein said means responsive to the actual air-fuel mixture existing within said internal combustion engine includes means for sensing engine roughness.

13. The closed loop system of claim 1 wherein said accelerator means includes a closed loop fuel governing means for controllably maintaining the desired quantity of fuel supplied to said internal combustion engine.

14. The closed loop system of claim 13 wherein said accelerator means includes:

a manually positionable accelerator for commanding the quantity of fuel to be supplied to said engine and hence the engine speed desired by the operator;

a fuel inlet into said internal combustion engine;

means for supplying fuel into said fuel inlet;

a fuel metering rod disposed at least partially within said inlet for regulating the passage of fuel therethrough;

linkage means operatively coupled to said accelerator for moving in proportion to the operator commands transmitted thereto by said accelerator; and wherein said closed loop governor means includes:

electrical coil means having a hollow central portion;

a rod-like member disposed for relative movement within said hollow central portion, said electrical coil means being responsive to the relative position of said rod-like member within said hollow central portion for generating a voltage indicative thereof;

one of said electrical coil means and said rod-like member being operatively connected to said linkage means for relative movement therewith such that said relative position indicative voltage is also indicative of the desired engine speed commanded by the operator's positioning of said accelerator;

means responsive to said position indicative voltage for generating a first waveform whose frequency is determined by the value of said generated voltage;

means for generating a second waveform whose frequency is indicative of the actual engine speed;

means for comparing said first and second waveforms and generating an error signal indicative of the difference therebetween; and means closing a feed-back loop and responsive to said error signal for selectively positioning said fuel metering rod to control the quantity of fuel supplied to said internal combustion engine so as to maintain the desired engine speed commanded by the positioning of said accelerator.

15. An electrical system for controlling the air-fuel mixture in an internal combustion engine system having an intake system, at least one cylinder, a throttle valve disposed within said intake system for regulating the flow of air to said cylinder, means for metering a quantity of fuel into said cylinder, and manually operable accelerator means for positively controlling said fuel metering means, said electrical system comprising:

means responsive to one of said accelerator means and said fuel metering means for generating a first signal indicative of the quantity of fuel to be metered into said cylinder;

throttle valve positioning means responsive to a control signal for regulating the position of said throttle valve to selectively vary the flow of air into said cylinder;

means responsive to one of said throttle valve and said throttle valve positioning means for generating a second signal indicative of the actual air flow into said cylinder;

electronic control unit means responsive to at least said first and second signals for generating a base control signal commanding a predetermined desired air flow as a function of metered fuel and the like for controlling said throttle valve positioning means;

gas sensing means disposed in said engine for generating a feedback signal indicative of the actual air-fuel mixture existing therein;

loop-closing means responsive to said feed-back signal for correcting said base control signal such that said throttle valve positioning means is responsive to said corrected control signal for more accurately maintaining a desired air-fuel ratio in said internal combustion engine; and means responsive to said first signal for anticipating an undesirable condition of excessive enrichment and for generating a transient correction signal indicative thereof even before said gas sensing means detects the actual existence of same for immediately correcting said base control signal and temporarily increasing the air flow into said cylinder for minimizing said undesirable condition.

16. The system for controlling the air-fuel mixture in an internal combustion engine of claim 15 wherein said means for anticipating an undesirable condition of excessive enrichment includes means operatively coupled to said means for generating said first signal for computing the first derivative thereof and for generating a transient voltage spike correction signal whenever a rapid increase in said first signal occurs which indicates that an undesirable condition of excessive fuel enrichment is imminent.

17. The system for controlling the air-fuel mixture of an internal combustion engine of claim 15 wherein said throttle valve positioning means includes a DC servo motor responsive to said basic control signal, said corrected control signal and said transient correction signal for selectively positioning said throttle valve to vary the flow of air into said cylinder.

18. The sytem for controlling the air-fuel mixture in an internal combustion engine of claim 15 wherein said system further includes a closed loop governor means for controlling the metering of fuel into said cylinder.

19. The system for controlling the air-fuel mixture in an internal combustion engine of claim 18 wherein said governor means includes:

a linkage operatively coupled to said accelerator means for movement therewith;

electromagnetic means responsive to the relative movement of said linkage for generating an output voltage indicative thereof;

voltage controlled oscillator means for generating a first waveform having a frequency dictated by the value of said generated voltage and indicative of the desired engine speed commanded by the positioning of said accelerator means;

means for generating a second waveform whose frequency is indicative of the actual engine speed;

means for comparing said first and second waveforms and for outputting an error signal indicative of the difference therebetween; and means closing said feed-back loop and responsive to said error signal for selectively increasing and decreasing the quantity of fuel metered into said cylinder for maintaining the desired engine speed commanded by the operator's positioning of said accelerator means.

20. The system for controlling the air-fuel mixture in an internal combustion engine of claim 15 wherein said gas sensing means includes an oxygen sensing element.

21. An electrical system for controlling the air-fuel mixture in an internal combustion engine system having an intake system, at least one cylinder, a throttle valve disposed within said intake system for regulating the flow of air into said cylinder, means for metering a quantity of fuel into said cylinder, and manually operable accelerator means for positively controlling said fuel metering means, said electrical system comprising:

means responsive to one of said accelerator means in said fuel metering means for generating a first signal indicative of the quantity of fuel to be metered into said cylinder;

throttle valve positioning means responsive to a control signal for regulating the position of said throttle valve to selectively vary the flow of air into said cylinder;

means responsive to one of said throttle valve and said throttle valve positioning means for generating a second signal indicative of the actual air flow into said cylinder;

electronic control unit means responsive to at least said first and second signals for generating a base control signal commanding a predetermined desired air flow as a function of metered fuel and the like for controlling said throttle valve positioning means;

means for sensing engine roughness which is indicative of the actual existence of an improper air-fuel mixture within said engine and for generating a feed-back signal indicative thereof;

loop-closing means responsive to said feed-back signal for correcting said basic control signal such that said throttle valve positioning means is responsive to said corrected control signal for more accurately maintaining a desired air-fuel ratio in said internal combustion engine system; and means responsive to said first signal for anticipating an undesirable condition of excessive enrichment and for generating a transient correction signal indicative thereof even before said engine roughness sensing means detects the actual existence of other than the desired air-fuel mixture within said engine for immediately correcting said base control signal and temporarily increasing the air flow into said cylinder for minimizing said undesirable condition.

22. The system for controlling the air-fuel mixture in an internal combustion engine of claim 21 wherein said means for anticipating an undesirable condition of excessive enrichment includes means operatively coupled to said means for generating said first signal for computing the first derivative thereof and for generating a transient voltage spike correction signal whenever a rapid increase in said first signal occurs which indicates that an undesirable condition of excessive fuel enrichment is imminent.

23. The system for controlling the air-fuel mixture of an internal combustion engine of claim 21 wherein said throttle valve positioning means includes a DC servo motor responsive to said basic control signal, said corrected control signal or said transient correction signal for selectively positioning said throttle valve to vary the flow of air to said cylinder.

24. The system for controlling the air-fuel mixture in an internal combustion engine of claim 21 wherein said system further includes a closed loop governor means for controlling the metering of fuel into said cylinder.

25. The system for controlling the air-fuel mixture in an internal combustion engine of claim 24 wherein said governor means includes:

a linkage operatively coupled to said accelerator means for movement therewith;

electromagnetic means responsive to the relative movement of said linkage for generating an output voltage indicative thereof;

voltage controlled oscillator means for generating a first waveform having a frequency dictated by the value of said generated voltage and indicative of the desired engine speed commanded by the positioning of said accelerator means;

means for generating a second waveform whose frequency is indicative of the actual engine speed;

means for comparing said first and second waveforms and for outputting an error signal indicative of the difference therebetween; and means closing said feed-back loop and responsive to said error signal for selectively increasing and decreasing the quantity of fuel metered into said cylinder for maintaining the desired engine speed commanded by the operator's positioning of said accelerator means.

26. A closed loop method of maintaining a desired air-fuel ratio in an internal combustion engine comprising the steps of:

supplying a quantity of fuel to said engine under operator command;

measuring a first parameter indicative of the actual air flow into said engine;

controlling the air flow into said engine as a function of said quantity of fuel supplied to said engine under operator command and said first measured parameter indicative of actual air flow into said engine;

measuring another engine operating parameter indicative of the actual air-fuel mixture existing in said engine; and selectively increasing and decreasing said controlled air flow in response to said measured engine operating parameter indicative of the actual air-fuel mixture existing in said engine in a closed loop manner so as to maintain a desired optimal air-fuel ratio under substantially all engine operating conditions.

27. The closed loop method of maintaining a desired air-fuel ratio of claim 26 further including the additional step of anticipating an impending undesirable condition of excessive fuel enrichment and increasing air flow to minimize said undesirable condition.

28. The closed loop method of maintaining a desired air-fuel ratio of claim 26 further including the steps of monitoring the rate at which said quantity of fuel is supplied to said engine, predicting an undesirable condition of excessive fuel enrichment whenever said monitored rate of fuel supply increases, and temporarily and immediately increasing said controlled air flow to minimize said undesirable condition of excessive fuel enrichment.

29. The closed loop method of maintaining a desired air-fuel ratio of claim 26 wherein said step of measuring an engine operating parameter indicative of the actual air-fuel mixture existing within said engine includes the step of sensing the oxygen content of the gases existing within said engine.

30. The closed loop method of maintaining a desired air-fuel ratio of claim 26 wherein said step of measuring an engine operting parameter indicative of the actual air-fuel mixture existing within said engine includes the step of sensing engine roughness as a measure of an actually existing but undesirable air-fuel mixture.

31. The closed loop method of maintaining a desired air-fuel ratio of claim 26 wherein said step of supplying a quantity of fuel to said engine under operator command includes generating a first signal waveform indicative of the desired engine speed as a function of the operator commanded supply of fuel, generating a second signal waveform indicative of the actual engine speed, comparing said first and second signal waveforms and generating an error signal indicative of the difference therebetween, and increasing and decreasing said quantity of fuel supplied to said engine in a closed loop manner in response to said error signal until said operator commanded desired engine speed is attained.

32. In a system for controlling the air-fuel mixture in an internal combustion engine having at least one engine cylinder, a closed loop method of maintaining a desired optimal air-fuel ratio under various operating conditions comprising the steps of:

feeding an operator-commanded quantity of fuel into said cylinder;

generating a first signal indicative of the quantity of fuel fed into said cylinder;

generating a second signal indicative of the actual air flow into said cylinder;

computing a basic control signal indicative of the desired air flow as a function of said first and second signals;

sensing the oxygen present in the air-fuel mixture actually existing in said engine;

generating a third signal indicative of the actual air-fuel mixture as a function of the quantity of sensed oxygen present therein;

adjusting said basic control signal in a closed loop manner to increase and decrease computed air flow to more precisely maintain said desired air-fuel ratio;

monitoring the rate of change of said quantity of fuel commanded to be fed into said cylinder to anticipate an impending undesirable condition of excessive fuel enrichment; and generating a transient signal for adjusting said basic control signal even before said oxygen-sensing step is able to detect the actual existence of said undesirable condition to temporarily increase the air flow into said cylinder so as to minimize said undesirable condition of excessive enrichment.

33. In a system for controlling the air-fuel mixture in an internal combustion engine having at least one engine cylinder, a closed loop method of maintaining a desired optimal air-fuel ratio under various operating conditions comprising the steps of:

feeding an operator-commanded quantity of fuel into said cylinder;

generating a first signal indicative of the quantity of fuel fed into said cylinder;

generating a second signal indicative of the actual air flow into said cylinder;

computing a basic control signal indicative of desired air flow as a function of said first and second signals;

monitoring engine roughness as a measure of undesirably high and undesirably low actual air-fuel mixtures existing within said engine;

generating a third signal from said monitored engine roughness, said third signal being indicative of the magnitude of said undesirably high or low air fuel mixture actually existing within said engine;

adjusting said basic control signal in a closed loop manner to increase and decrease computed air flow to more precisely maintain said desired air-fuel ratio;

monitoring the rate of change of said quantity of fuel commanded to be fed into said cylinder to anticipate an impending undesirable condition of excessive fuel enrichment; and generating a transient signal for adjusting said basic control signal even before said engine roughness monitoring means is able to detect said undesirably high or low air-fuel mixture within said engine to temporarily increase the air flow into said cylinder in order to minimize said undesirable condition of excessive enrichment.

* * * * *

UNITED STATES PATENT AND TRADEMARK OFFICE

CERTIFICATE OF CORRECTION

PATENT NO. : 4,138,979

DATED : February 13, 1979

INVENTOR(S) : Lael B. Taplin

It is certified that error appears in the above-identified patent and that said Letters Patent are hereby corrected as shown below:

Column 12, Line 65, before "1" in the equation insert --- [ ---;

and after "$(T-T_o)$" insert --- $]\sqrt{T_A}$ ---;

Column 13, line 18, delete "$P_m P_a - P_m$" and insert therefor the following:

$$\sqrt{P_m}\sqrt{P_a - P_m}$$

Signed and Sealed this

*Eighteenth* Day of *November 1980*

[SEAL]

*Attest:*

SIDNEY A. DIAMOND

*Attesting Officer*

*Commissioner of Patents and Trademarks*